US008755725B2

(12) United States Patent
Kondo et al.

(10) Patent No.: US 8,755,725 B2
(45) Date of Patent: Jun. 17, 2014

(54) FIXING DEVICE HAVING FLEXIBLE FUSING MEMBER

(75) Inventors: Tomohiro Kondo, Nagoya (JP); Hisashi Tsukawaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 99 days.

(21) Appl. No.: 13/334,165

(22) Filed: Dec. 22, 2011

(65) Prior Publication Data

US 2012/0163884 A1 Jun. 28, 2012

(30) Foreign Application Priority Data

Dec. 24, 2010 (JP) ..... 2010-287935

(51) Int. Cl.
*G03G 15/20* (2006.01)

(52) U.S. Cl.
CPC ..... *G03G 15/2017* (2013.01); *G03G 15/2064* (2013.01); *G03G 2215/2035* (2013.01)
USPC ..... 399/329; 399/333

(58) Field of Classification Search
CPC ..... G03G 15/2017; G03G 15/2064; G03G 2215/2035
USPC ..... 399/329, 333
See application file for complete search history.

(56) References Cited

U.S. PATENT DOCUMENTS 4,187,033 A * 2/1980 Zukowski ..... 403/137
6,456,818 B1 9/2002 Nakayama et al.
6,501,935 B2 12/2002 Hirai et al.
6,830,212 B1 * 12/2004 Harris ..... 242/615.1
7,242,895 B2 7/2007 Inada et al.
7,283,780 B2 * 10/2007 Uchida et al. ..... 399/329
7,593,678 B2 9/2009 Suenaga
7,664,448 B2 2/2010 Lee et al.
7,881,650 B2 2/2011 Shin et al.
7,965,970 B2 6/2011 Haseba et al.
8,032,069 B2 10/2011 Shin et al.
8,131,197 B2 3/2012 Hiraoka et al.

(Continued)

FOREIGN PATENT DOCUMENTS

CN 101261481 A 9/2008
CN 101846944 A 9/2010

(Continued)

OTHER PUBLICATIONS

Non-final Office Action received in U.S. Appl. No. 13/334,157 mailed May 15, 2013.

(Continued)

*Primary Examiner* — Benjamin Schmitt
(74) *Attorney, Agent, or Firm* — Banner & Witcoff, Ltd.

(57) ABSTRACT

A fixing device includes a tubular flexible fusing member, a heater, a nip member, a backup member, and a restricting member. The fusing member is rotatable about a rotational axis defining an axial direction and has an inner peripheral surface defining an internal space. The heater is disposed in the internal space. The nip member is disposed in the internal space for receiving radiant heat from the heater. The nip member is in sliding contact with the inner peripheral surface. The backup member nips the fusing member in cooperation with the nip member. The restricting member restricts displacement of the fusing member in the axial direction and is tiltable about a fulcrum portion.

13 Claims, 9 Drawing Sheets

(56) References Cited

U.S. PATENT DOCUMENTS

| | | | | |
|---|---|---|---|---|
| 2001/0022909 | A1 | 9/2001 | Takeuchi et al. | |
| 2002/0018676 | A1 | 2/2002 | Hirai et al. | |
| 2002/0039504 | A1 | 4/2002 | Nakayama et al. | |
| 2003/0185604 | A1 * | 10/2003 | Sato | 399/329 |
| 2005/0185994 | A1 | 8/2005 | Inada et al. | |
| 2005/0191097 | A1 | 9/2005 | Yoshida et al. | |
| 2007/0059001 | A1 | 3/2007 | Matsuura et al. | |
| 2007/0059022 | A1 | 3/2007 | Yamaoka et al. | |
| 2007/0212135 | A1 | 9/2007 | Suenaga | |
| 2008/0112739 | A1 | 5/2008 | Shinshi | |
| 2008/0124147 | A1 | 5/2008 | Uehara et al. | |
| 2008/0219723 | A1 | 9/2008 | Lee et al. | |
| 2008/0292374 | A1 | 11/2008 | Hiraoka et al. | |
| 2009/0047047 | A1 | 2/2009 | Ardery et al. | |
| 2009/0080954 | A1 | 3/2009 | Miyata et al. | |
| 2009/0092423 | A1 | 4/2009 | Shin et al. | |
| 2009/0208264 | A1 | 8/2009 | Fujiwara et al. | |
| 2010/0247183 | A1 | 9/2010 | Haseba et al. | |
| 2011/0091254 | A1 | 4/2011 | Shin et al. | |
| 2011/0129267 | A1 | 6/2011 | Arimoto et al. | |
| 2011/0170917 | A1 | 7/2011 | Yoshikawa et al. | |
| 2012/0093548 | A1 | 4/2012 | Kimura | |

FOREIGN PATENT DOCUMENTS

| | | | |
|---|---|---|---|
| JP | H04-122969 | A | 4/1992 |
| JP | 05-341685 | A | 12/1993 |
| JP | 06-118823 | A | 4/1994 |
| JP | 06-282183 | | 10/1994 |
| JP | 08-248791 | | 9/1996 |
| JP | 10-268681 | A | 10/1998 |
| JP | 10-340017 | | 12/1998 |
| JP | 2000-330417 | | 11/2000 |
| JP | 2002-123107 | A | 4/2002 |
| JP | 2003-316181 | | 11/2003 |
| JP | 2004-198556 | A | 7/2004 |
| JP | 2005-010201 | | 1/2005 |
| JP | 2005-234294 | A | 9/2005 |
| JP | 2007-017772 | | 1/2007 |
| JP | 2007-279665 | A | 10/2007 |
| JP | 2008-224878 | A | 9/2008 |
| JP | 2008-233886 | | 10/2008 |
| JP | 2008-292793 | A | 12/2008 |
| JP | 2009-093141 | A | 4/2009 |
| JP | 2009-237089 | | 10/2009 |

OTHER PUBLICATIONS

Co-pending U.S. Appl. No. 13/334,170, filed Dec. 22, 2011.
Co-pending U.S. Appl. No. 13/334,157, filed Dec. 22, 2011.
Co-pending U.S. Appl. No. 13/334,183, filed Dec. 22, 2011.
Extended EP Search Report mailed May 3, 2012, EP Appln. 11192796.8-2216.
JP Office Action mailed Jan. 22, 2013, JP Appln. 2010-288620, English Translation.
JP Office Action mailed Jan. 15, 2013, JP Appln. 2010-287935, English Translation.
JP Office Action mailed Jan. 15, 2013, JP Appln. 2010-287377, English Translation.
JP Office Action mailed Jan. 15, 2013, JP Appln. 2010-287371, English Translation.
Non-final Office Action received in U.S. Appl. No. 13/334,170 mailed Jul. 11, 2013.
English Translation JP2004-198556 dated Jul. 11, 2013.
Non-Final Office Action issued in U.S. Appl. No. 13/334,183 mailed Dec. 4, 2013.
Machine translation of JP06-118823.
Final Office Action issued in U.S. Appl. No. 13/334,157 mailed Oct. 22, 2013.
CN First Office Action mailed Jan. 21, 2014, CN appln. 201110441042.5, English Translation.
Notice of Allowance issued in corresponding U.S. Appl. No. 13/334,157 mailed Feb. 28, 2014.
Final Office Action received in U.S. Appl. No. 13/334,170 mailed Apr. 9, 2014.
Notice of Allowance issued in corresponding U.S. Appl. No. 13/334,183 mailed Mar. 13, 2014.

* cited by examiner

FIXING DEVICE HAVING FLEXIBLE FUSING MEMBER

CROSS REFERENCE TO RELATED APPLICATION

This application claims priority from Japanese Patent Application No. 2010-287935 filed Dec. 24, 2010. The entire content of this priority application is incorporated herein by reference.

TECHNICAL FIELD

The present invention relates to a fixing device mounted in an electrophotographic type image forming device.

BACKGROUND

A conventional fixing device includes a cylindrical fusing film, a heater provided in an internal space of the fusing film, a pressure roller disposed opposite to the heater with respect to the fusing film, and a circular flange member for restricting a displacement of the fusing film in an axial direction thereof. A sheet carrying a toner image is passed through a nip portion defined between the circular film and the pressure roller, so that the toner image can be thermally fixed onto the sheet.

The circular flange member has a regulation portion to which an axial end portion of the fusing film is abutted for regulating axial displacement of the film. The circular flange member also has a guide portion integral with the regulation portion and in sliding contact with an inner peripheral surface of the film for guiding rotation of the film. The regulation portion extends in a direction perpendicular to a rotation axis of the cylindrical film. Such conventional fixing device is disclosed in Japanese Patent Application Publication No. 2009-237089.

SUMMARY

The present inventors have found drawbacks in such a conventional fixing device, such that only a portion of the axial end portion of the circular film is brought into abutment with the regulation portion, if the axial end of the film is not orthogonal to the rotational axis of the film due to production error or assembling error or unwanted displacement of the film in association with the rotation of the film. The axially displacing force of the circular film is only received by the portion of the axial end portion contacting the regulation portion. Therefore, the portion of the axial end portion may be buckled or degraded.

Even if the axial end portion of the film is orthogonal to the rotation axis, such partial contact of the axial end portion of the circular film may also occur due to production error or assembling error of the circular flange member in which the regulation surface of the flange member is not directed in a direction perpendicular to the rotation axis.

In view of the foregoing, it is an object of the invention to provide a fixing device capable of suppressing deformation and degradation of the fusing film.

In order to attain the above and other objects, the present invention provides a fixing device. The fixing device includes a tubular flexible member, a heater, a nip member, a backup member, and a restricting member. The fusing member is rotatable about a rotational axis defining an axial direction and has an inner peripheral surface defining an internal space. The heater is disposed in the internal space. The nip member is disposed in the internal space for receiving radiant heat from the heater. The nip member is in sliding contact with the inner peripheral surface. The backup member nips the fusing member in cooperation with the nip member. The restricting member restricts displacement of the fusing member in the axial direction and is tiltable about a fulcrum portion.

According to another aspect, the present invention provides a fixing device. The fixing device includes a tubular flexible fusing member, a nip member, a backup member, and a restricting member. The fusing member is rotatable about a rotational axis defining an axial direction and has an inner peripheral surface defining an internal space. The nip member is disposed in the internal space. The nip member is configured to be in sliding contact with the inner peripheral surface. The backup member is configured to nip the fusing member in cooperation with the nip member. The restricting member is configured to restrict displacement of the fusing member in the axial direction and is tiltable about a fulcrum portion.

According to still another aspect, the present invention provides a fixing device. The fixing device includes a tubular film, a nip plate, a backup roller and a restricting member. The tubular film is rotatable about a rotational axis defining an axial direction and has an inner peripheral surface defining an internal space. The nip plate is disposed in the internal space. The nip plate is configured to be in sliding contact with the inner peripheral surface. The backup roller is configured to nip the film in cooperation with the nip plate. The restricting member is configured to restrict displacement of the film in the axial direction and is tiltable about a fulcrum portion.

DETAILED DESCRIPTION

Figure 1:
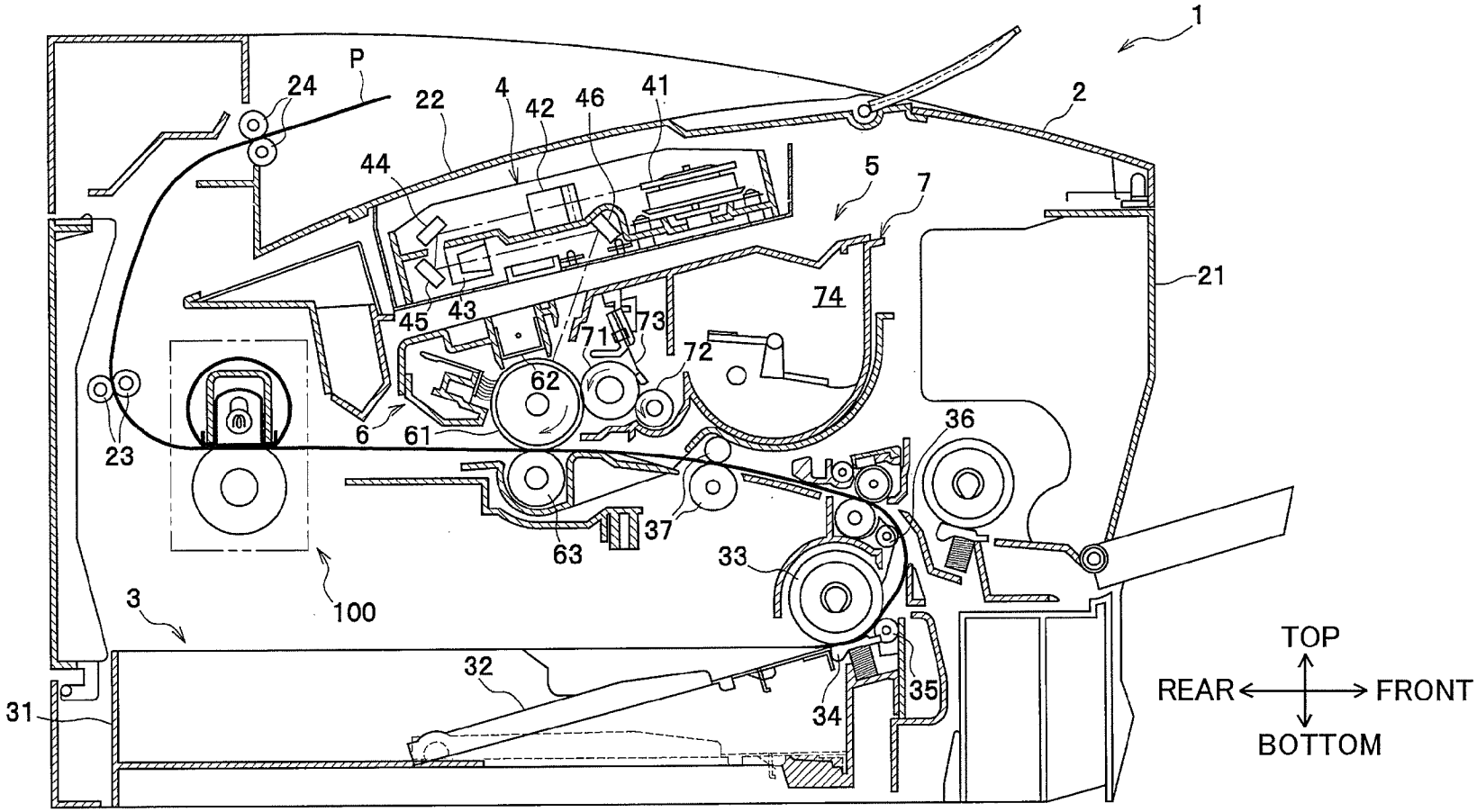
FIG. 1 is a schematic cross-sectional view showing a structure of a laser printer having a fixing device according to an embodiment of the present invention.

Next, a general structure of a laser printer as an image forming device according to an embodiment of the present invention will be described with reference to accompany drawings. The laser printer 1 shown in FIG. 1 is provided with a fixing device 100 according to the embodiment of the present invention. A detailed structure of the fixing device 100 will be described later.

<General Structure of Laser Printer>

As shown in FIG. 1, the laser printer 1 includes a main frame 2 with a movable front cover 21. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" and the like will be used assuming that the laser printer 1 is disposed in an orientation in which it is intended to be used. More specifically, in FIG. 1, a left side and a right side are a rear side and a front side, respectively.

The main frame 2 has a lower portion where the sheet supply unit 3 is disposed. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35, 36, and the registration rollers 37.

The main frame 2 has an upper portion where exposure unit 4 is disposed. The exposure unit 4 includes a laser emission unit (not shown), a polygon mirror 41, lenses 42, 43, and reflection mirrors 44, 45, 46. In the exposure unit 4, the laser emission unit is adapted to project a laser beam (indicated by a chain line in FIG. 1) based on image data so that the laser beam is deflected by or passes through the polygon mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a regulation blade 73, and a toner accommodating portion 74 in which toner (developing agent) is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the regulation blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
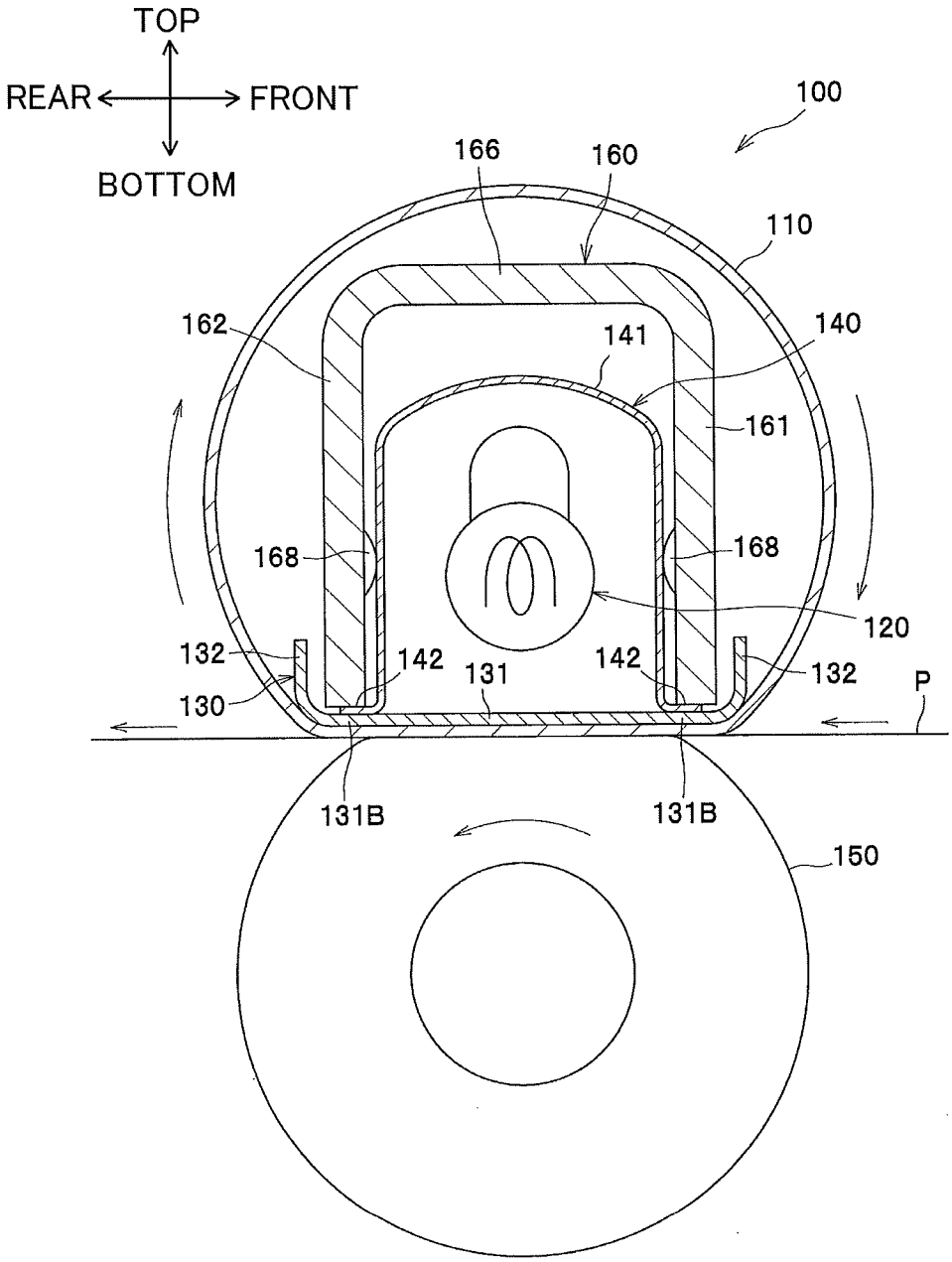
FIG. 2 is a schematic cross-sectional view showing a structure of the fixing device.

As shown in FIG. 2, the fixing device 100 includes a flexible tubular fusing member such as a tube or film 110, a halogen lamp 120, a nip plate 130, a reflection plate 140, a pressure roller 150, and a stay 160.

The fusing film 110 is of a tubular configuration having heat resistivity and flexibility. The fusing film 110 has an internal space for accommodating the halogen lamp 120, the nip plate 130, the reflection plate 140, and the stay 160. The rotation of the fusing film 110 is guided by a guide assembly 170 described later at its width ends.

Figure 3:
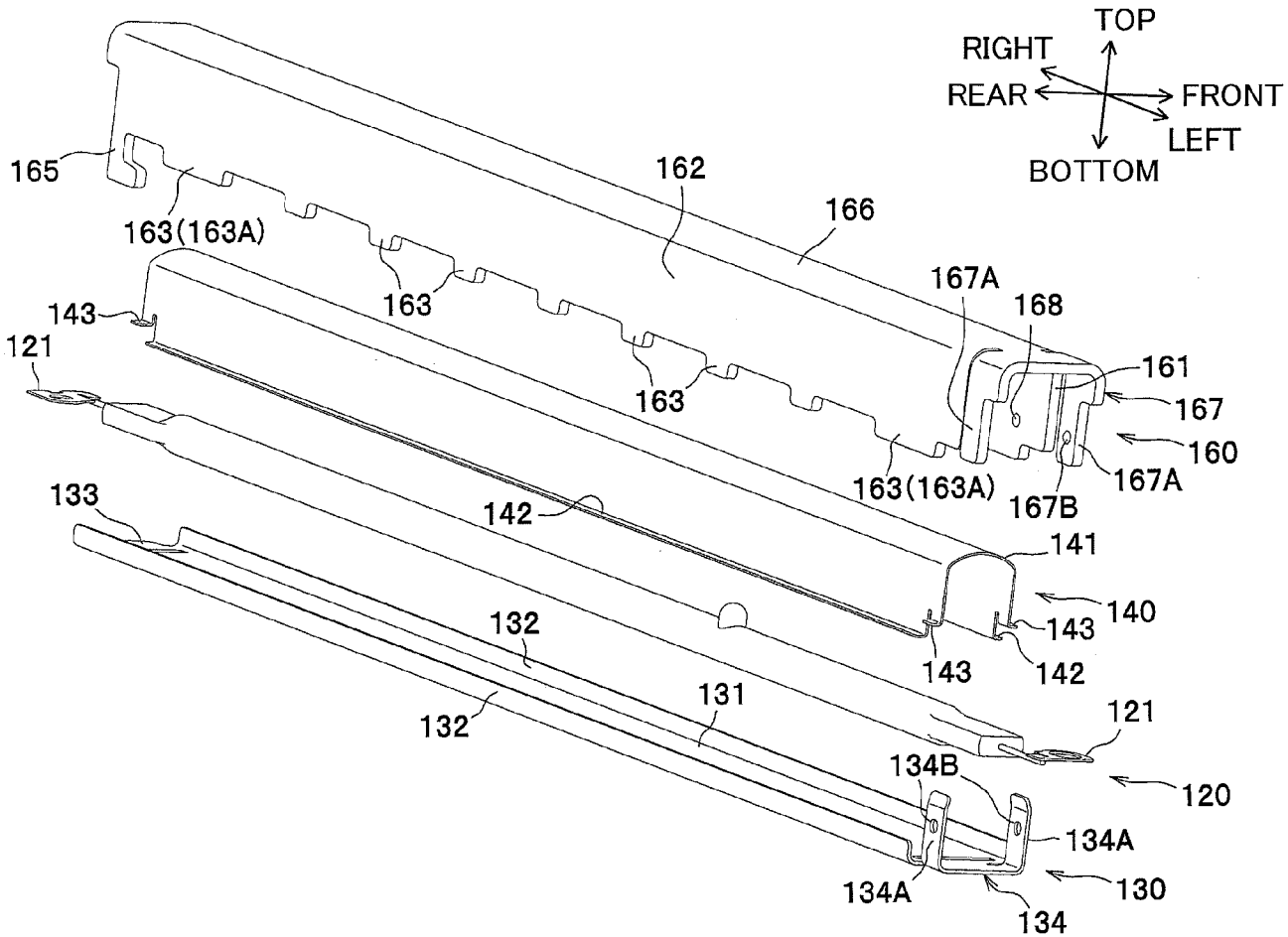
FIG. 3 is an exploded perspective view showing a halogen lamp, a nip plate, a reflection plate, and a stay.

The halogen lamp 120 is a heater to heat the nip plate 130 and the fusing film 110 for heating toner on the sheet P. The halogen lamp 120 is positioned at the internal space of the fusing film 110. The fusing film 110 and the nip plate 130 respectively have an inner surface spaced away from the halogen lamp 120 by a predetermined distance. As shown in FIG. 3, electrical terminals 121 are provided at each longitudinal end portion of the halogen lamp 120

The nip plate 130 has a plate shape and contacts with the inner surface of the fusing film 110. The nip plate 130 is adapted for receiving resident heat from the halogen lamp 120 and for transmitting resident heat to the toner on the sheet P through the fusing film 110.

The nip plate 130 has a generally U-shaped cross-section made from a material such as aluminum having a thermal conductivity higher than that of the stay 160 (described later) made from steel. More specifically, for fabricating the nip plate 130, an aluminum plate is bent into U-shape to provide a base portion 131 and upwardly folded portions 132.

The base portion 131 may be painted with black color or provided with a heat absorbing member. With this configuration, the nip plate 130 effectively receives resident heat from the halogen lamp 120.

As shown in FIG. 3, the nip plate 130 has a right end portion provided with an insertion portion 133 extending flat, and a left end portion provided with an engagement portion 134. The engagement portion 134 has U-shaped configuration as viewed from a left side and includes side wall portions 134A extending upward and formed with engagement holes 134B.

The reflection plate 140 is adapted to reflect radiant heat radiating in the front-to-rear direction and the upper direction from the halogen lamp 120 toward the nip plate 130 (toward the inner surface of the base portion 131). As shown in FIG. 2, the reflection plate 140 is positioned within the fusing film 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing film 110.

The reflection plate 140 is configured into U-shape in cross-section and is made from a material such as aluminum having high reflection ratio regarding infrared ray and far infrared ray. The reflection plate 140 has a U-shaped reflection portion 141 and a flange portion 142 extending from each end portion of the reflection portion 141 in the front-to-rear direction. A mirror surface finishing is available on the surface of the aluminum reflection plate 140 for specular reflection in order to enhance heat reflection ratio.

As shown in FIG. 3, two engagement sections 143 are provided at each widthwise end of the reflection plate 140.

Figure 4:
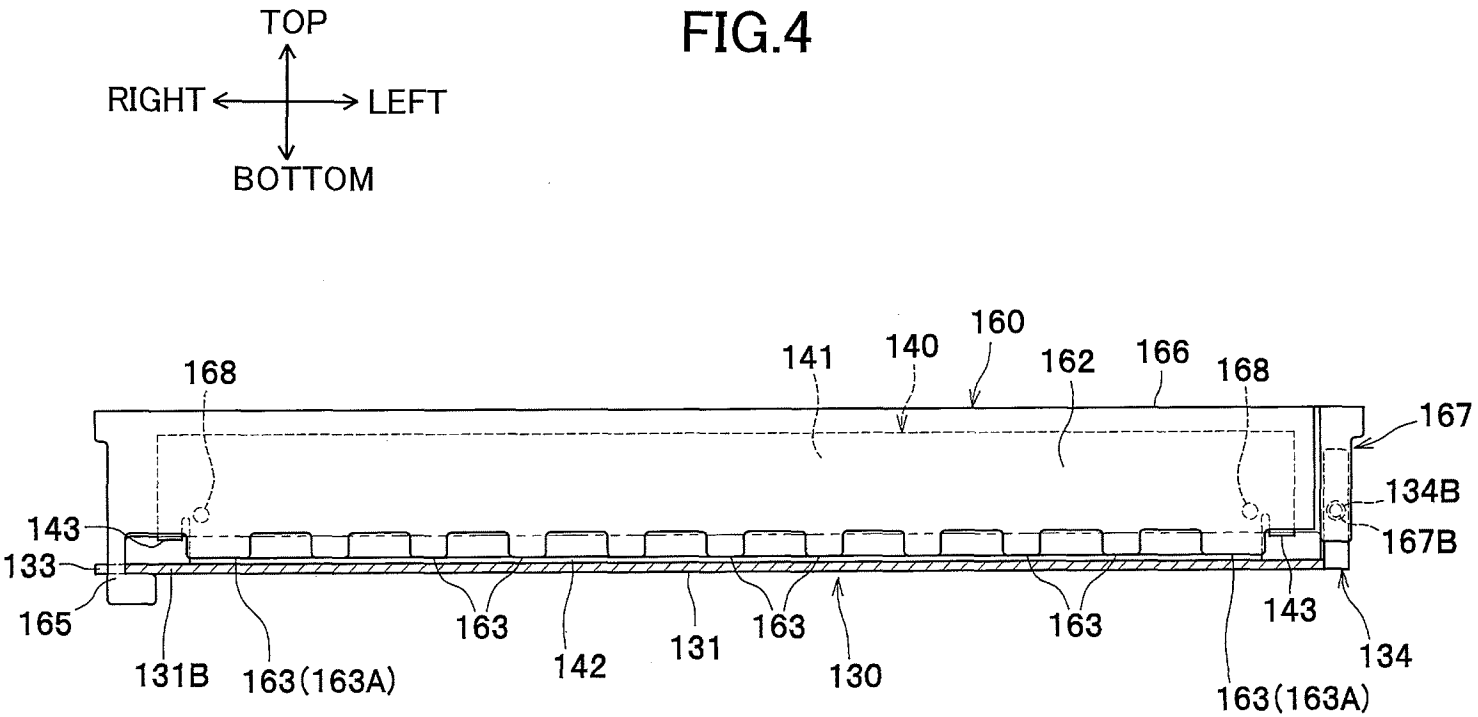
FIG. 4 is a rear view showing an assembled state of the nip plate, the reflection plate and the stay.

Each engagement section 143 is positioned higher than the flange portion 142. As a result of assembly of the nip plate 130 together with the reflection plate 140 and the stay 160 as shown in FIG. 4, comb-like contact portions 163 of the stay 160 described later are nipped between the right and left engagement sections 143. That is, the right engagement section 143 is in contact with the rightmost contact portion 163A, and the left engagement section 143 is in contact with the leftmost contact portion 163A.

As a result, displacement of the reflection plate 140 in the right-to-left direction due to vibration caused by operation of the fixing device 100 can be restrained by the engagement between the engagement sections 143 and the comb-like contact portions 163A.

As shown in FIG. 2, the pressure roller 150 is elastically deformable and is positioned below the nip plate 130. The deformed pressure roller 150 nips the fusing film 110 in cooperation with the nip plate 130 to provide a nip region for nipping the sheet P between the pressure roller 150 and the fusing film 110. To provide the nip region, a biasing member such as a spring urges one of the nip plate 130 and the pressure roller 150 toward the other.

The pressure roller 150 is rotationally driven by a drive motor (not shown) disposed in the main frame 2. By the rotation of the pressure roller 150, the fusing film 110 is circularly moved along the nip plate 130 because of a friction force generated therebetween or between the sheet P and the fusing film 110. A toner image on the sheet P can be thermally fixed thereto by heat and pressure during passage of the sheet P at the nip region between the pressure roller 150 and the fusing film 110.

The stay 160 is adapted to support the end portions 131B of the nip plate 130 via the flange portion 142 of the reflection plate 140 for maintaining rigidity of the nip plate 130. The stay 160 has a U-shape configuration in conformity with the outer shape of the reflection portion 141 covering the reflection plate 140. For fabricating the stay 160, a highly rigid member such as a steel plate is folded into U-shape to have a top wall 166, a front wall 161 and a rear wall 162. As shown in FIG. 3, each of the front wall 161 and the rear wall 162 has a lower end portion provided with comb-like contact portions 163.

The front and rear walls 161, 162 have right end portions provided with L shaped engagement legs 165 each extending downward and then leftward. The top wall 166 has a left end portion provided with a retainer 167 having U-shaped configuration. The retainer 167 has a pair of retaining walls 167A whose inner surfaces are provided with engagement bosses 167B protruding inward.

As shown in FIGS. 2 and 3, each width end portion of each of the front wall 161 and the rear wall 162 has an inner surface provided with two abutment bosses 168 protruding inward in abutment with front and rear side walls of the reflection plate 140 in the front-to-rear direction. Therefore, displacement of the reflection plate 140 in the front-to-rear direction due to vibration caused by operation of the fixing device 100 can be restrained because of the abutment of the reflection portion 141 with the bosses 168.

Assembling procedure of the reflection plate 140 and the nip plate 130 to the stay 160 will be described. First, the reflection plate 140 is temporarily assembled to the stay 160 by the abutment of the outer surface of the reflection portion 141 on the abutment bosses 168. In this case, the engagement sections 143 are in contact with the widthwise endmost contact portions 163A.

Then, as shown in FIG. 4, the insertion portion 133 is inserted between the engagement legs 165 and 165, so that the base portion 131 can be brought into engagement with the engagement legs 165. Thereafter, the engagement bosses 167B are engaged with the engagement holes 134B.

The end portion 131B of the base portion 131 is supported on the engagement legs 165 and the engagement portion 134 is supported on the retainer 167. Each flange portion 142 is sandwiched between the nip plate 130 and the stay 160. Thus, the nip plate 130 and the reflection plate 140 are held to the stay 160.

Vertical displacement of the reflection plate 140 due to vibration caused by operation of the fixing device 100 can be restrained, since the flange portions 142 are held between the nip plate 130 and the stay 160 as shown in FIG. 2. Thus, position of the reflection plate 140 relative to the nip plate 130 can be fixed.

Figure 5:
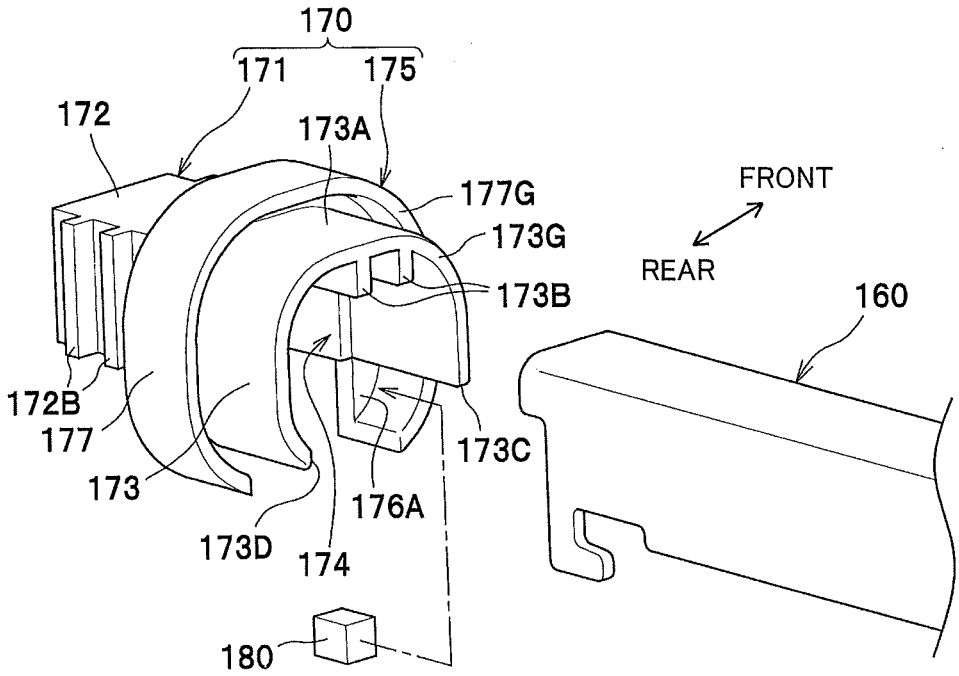
FIG. 5 is a rear perspective view of a guide member.
Figure 6:
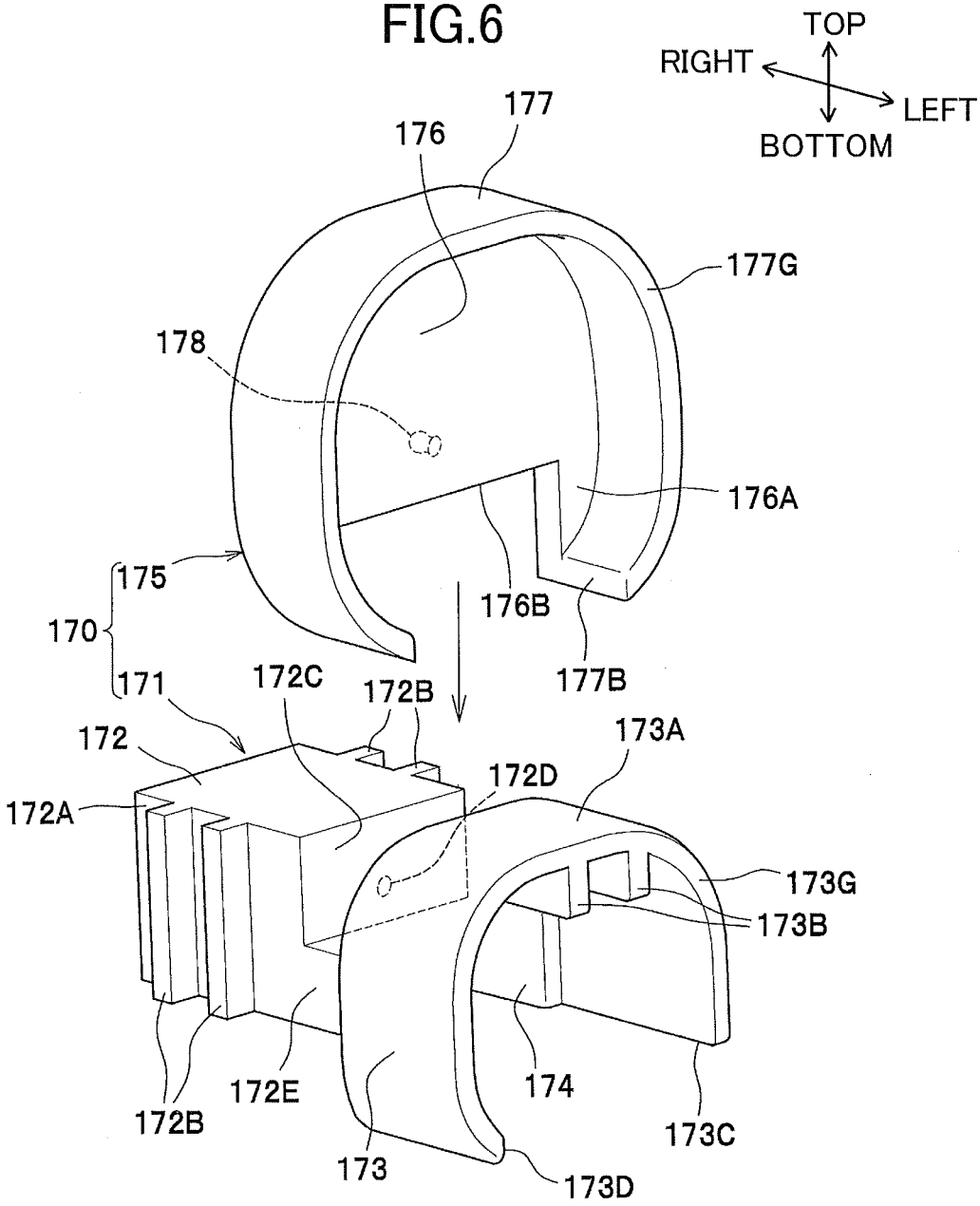
FIG. 6 is an exploded perspective view of the guide member.

Incidentally, the stay 160 holding the nip plate 130 and the reflection plate 140 and the halogen lamp 120 are directly held to the guide assembly 170 as shown in FIGS. 5 and 6. That is, the guide assembly 170 integrally supports the fusing film 110, the halogen lamp 120, the nip plate 130, the reflection plate 140, and the stay 160.

The guide assembly 170 is made from insulating member such as resin and is disposed at each axial end portion of the fusing film 110. The guide assembly 170 is in abutment with each axial end of the fusing film 110 in order to restrict displacement of the fusing film 110 in the right-to-left direction (axial direction). Specifically, the guide assembly 170 includes an inner guide member 171 for guiding the rotation of the fusing film 110 and a restricting member 175 for restricting displacement of the fusing film 110 in the right-to-left direction. The restricting member 175 is tiltably movably mounted on the inner guide member 171.

The inner guide member 171 mainly includes a main body 172, an inner guide 173 provided on the main body 172 at a side of the film 110, and a support portion 174 for holding widthwise end of the stay 160.

Figure 7A:
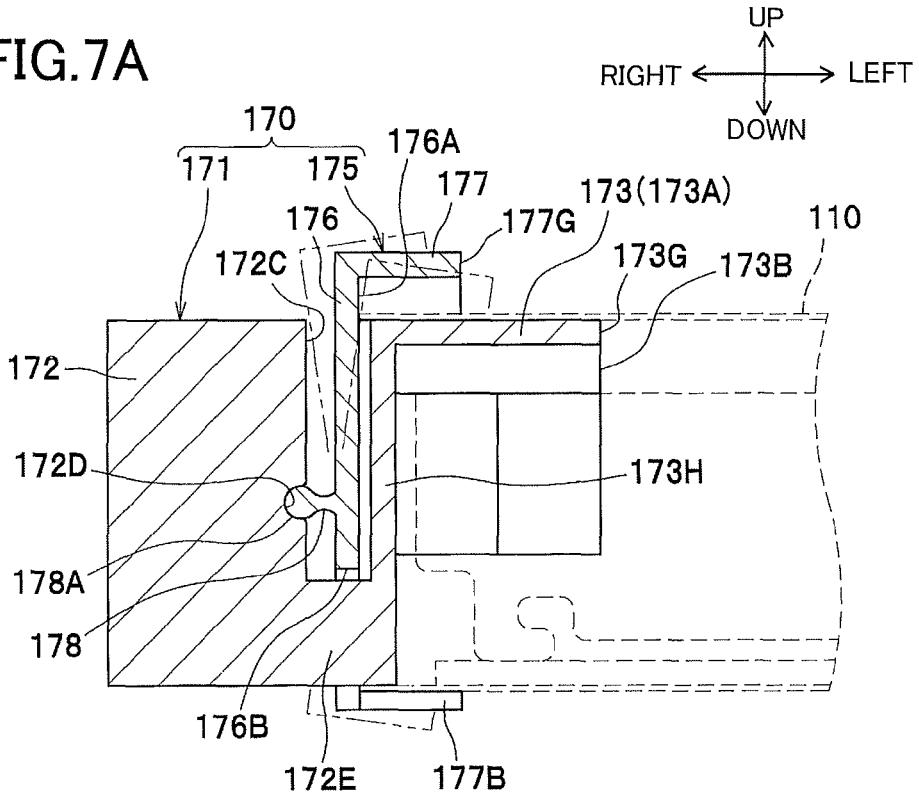
FIG. 7A is a vertical cross-sectional view of the guide member.
Figure 7B:
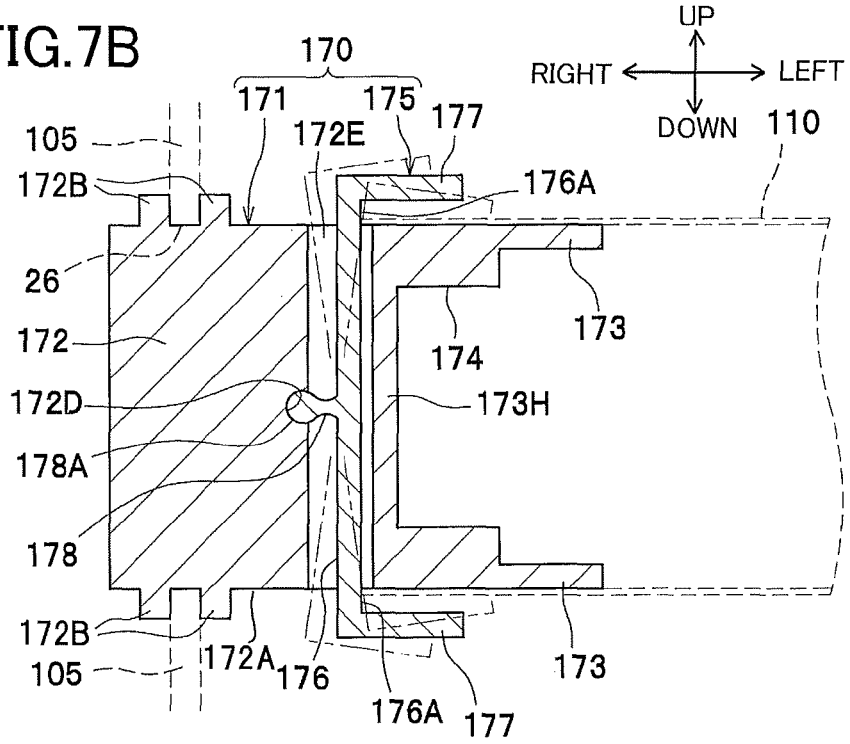
FIG. 7B is a horizontal cross-sectional view of the guide member.

The main body 172 is of rectangular shape and fixed to the main frame 2 of the laser printer 1. The main body 172 has side surfaces 172A in the front-to-rear direction each provided with a pair of protrusions 172B and a lateral surface 172C opposed to the inner guide 173. Specifically, as shown in FIG. 7B, the fixing device 100 further includes a wall portion 105 serving as a casing to which the pair of protrusions 172B of the main body 172 is fixed. The lateral surface 172C has a center region formed with a spherical receiving portion 172D for tiltably supporting the restricting member 175 and a bottom portion provided with an extending portion 172E for supporting the inner guide 173.

The inner guide 173 is in the form of a rib in sliding contact with the inner surface of the fusing film 110 to guide the rotation thereof and is of C-shape having cutout part in the bottom. As shown in FIGS. 6 and 7A, the inner guide 173 includes an upper wall 173A, a support portion 173B, a front edge 173C, a rear edge 173D, a side wall 173G, and a connecting portion 173H that provides connection of the upper wall 173A with the extending portion 172E. The inner guide 173 is inserted into the internal space of the fusing film 110 to restrain radially inward deformation of the fusing film 110. The stay 160 is fittingly inserted into the support portion 174 through the cutout part of the inner guide 173.

Two support portions 173B are integrally with the upper wall 173A for supporting an upper surface of the stay 160. The support portion 173B is a rib protruding downward from the upper wall 173A and extending in the right-to-left direction. One of the support portions 173B is spaced away from remaining support portion 173B in order to evenly support the stay 160 at a front and rear portion thereof.

The front edge 173C is positioned higher than the rear edge 173D in a vertical direction, as shown in FIG. 5. A space is defined immediately below the front edge 173C to accommodate a thermometer 180 adapted to detect a temperature of the nip plate 130. That is, the space is provided for preventing the interference between the inner guide 173 and the thermometer 180.

The support portion 174 has a groove-like shape with its bottom portion open for holding the stay 160 in the front-to-rear direction. The support portion 174 includes a fixing portion (not shown) for fixing the terminal 121 of the halogen lamp 120 (FIG. 3).

The restricting member 175 is configured to restrict a displacement of the fusing film 110 in the right-to-left direction and is tiltable in a gimbal fashion (like a universal joint) about a fixed fulcrum point or portion with respect to the inner guide member 171. The restricting member 175 includes a restricting portion 176 in abutment with the axial end of the fusing film 110, an outer guide 177 extending from the restricting portion 176 toward the fusing film 110, and a protruding portion 178 protruding from the restricting portion 176 toward the main body 172.

The restricting portion 176 is a semicircular shaped wall disposed between the inner guide member 171 of the main body 172 and the inner guide 173. The restricting portion 176 has a radially outer portion 176A located outside of the inner guide 173 in the radial direction as viewed from right-to-left direction, and has a concave portion 176B for preventing interference with the extending portion 172E of the inner guide member 171. The radially outer portion 176A is abuttable against the axial end of the fusing film 110. The radially outer portion 176A functions as a restricting plane for restricting a displacement of the fusing film 110 in the right-to-left direction (axial direction). As shown in FIGS. 7A and 7B, gaps are formed between the restricting portion 176 and the main body 172, between the restricting portion 176 and the inner guide 173, and between the restricting portion 176 and the extending portion 172E in order to permit the restricting member 175 to be tiltably movable.

The outer guide 177 shaped like a letter C with an opening downward is a rib for guiding an outer surface of the fusing film 110. The outer guide 177 is positioned outside of the fusing film 110 in the radial direction to restrain radially outward deformation of the fusing film 110. A gap is formed between the outer guide 177 and the inner guide 173. The gap is larger than the thickness of the fusing film 110. The opening of the outer guide 177 is adapted for positioning the inner guide 173 within the space of the outer guide 177 and for permitting the stay 160 to be held to the support portion 174 in cooperation with the bottom opening of the inner guide 173. The outer guide 177 has lower edge portions 177B positioned lower than the inner guide member 171.

The protruding portion 178 and the spherical receiving portion 172D function as the fulcrum point or fulcrum portion when the restricting member 175 tilts. The protruding portion 178 has a distal end provided with a spherical portion 178A. The spherical portion 178A is pivotally supported to the spherical receiving portion 172D of the main body 172. The spherical portion 178A has a diameter substantially equal to that of the spherical receiving portion 172D. Consequently, the restricting member 175 is smoothly tiltable in all directions in a gimbal fashion or like a universal joint on a virtual plane perpendicular to the right-to-left direction. In this embodiment, the protruding portion 178 and the spherical receiving portion 172D are positioned in alignment with the internal space and located on an extension of an axial center of the fusing film 110.

With this configuration, the above-mentioned embodiment can attain advantageous effects as follows. The guide assembly 170 includes the inner guide member 171 and the restricting member 175 tiltable about the fulcrum point configured of the protruding portion 178 and the spherical receiving portion 172D. When the axial end of the fusing film 110 is in abutment with the restricting member 175, i.e., the restricting member 175 is pressed by the axial end of the fusing film 110, the restricting member 175 can tilt in all directions in the gimbal fashion on the virtual plane about the fulcrum point. Thus, even if the axial end of the fusing film 110 slants relative to the virtual plane, the restricting member 175 tilts along with the fusing film 110 so that entire axial end of the fusing film 110 is in abutment with the restricting member 175. This configuration prevents the axial end of the fusing film 110 from being partially and strongly pushed by the restricting member 175. Thus, deformation and degradation of the axial end portion can be obviated.

The protruding portion 178 protrudes toward the main body 172, and the spherical receiving portion 172D is formed on the lateral surface 172C. Even if the axial end of the fusing film 110 presses the restricting member 175 rightward, the fulcrum point configured of the protruding portion 178 and the spherical receiving portion 172D is immovable in the right-to-left direction (The main body 172 is held stationarily by the wall 105). That is, since a position of the fulcrum point in the right-to-left direction is fixedly provided, the restricting member 175 can stably tilt about the fulcrum point.

In the embodiment, the restricting member 175 is tiltably mounted on the inner guide member 171. Thus, the inner guide member 171 restricts the radially inward displacement of the fusing film 110, and simultaneously the restricting member 175 is tiltable in accordance with the slant of the axial end face of the fusing film 110.

The supporting portion is configured of the spherical portion 178A of the protruding portion 178 and the spherical receiving portion 172D of the main body 172. Thus, the restricting member 175 can tilt in all directions in the gimbal fashion on the virtual plane. Even if the axial end of the fusing film 110 slants in any directions, the restricting member 175 can tilt in conformance with the slanting direction of the axial end face of the fusing film 110. Thus any damage to the axial end portion of the fusing film 110 can be prevented. Additionally, the tilt of the restricting member 175 is achieved by the spherical portion 178A and the spherical receiving portion 172D without an urging member such as a spring. The restricting member 175 can tilt even by a slight pushing force of the fusing film 110. Therefore, axial position of the fusing film 110 can be properly regulated without any damage to the end portion thereof.

In the embodiment, the protruding portion 178 and the spherical receiving portion 172D are positioned in alignment with the internal space, and more specifically, are located on an extension of the axial center of the fusing film 110. Therefore, a distance between the fulcrum point and any point on the axial end of the fusing film 110 can be substantially uniform, and accordingly, stabilized tilting motion of the restricting member 175 can be realized.

Various modifications are conceivable. A first modification to the above-described embodiment will be described with reference to FIGS. 8A and 8B. In the first modification, like parts and components are designated by the same reference numerals added with 100 as those shown in FIGS. 1 through 7 to avoid duplicating description.

Figure 8A:
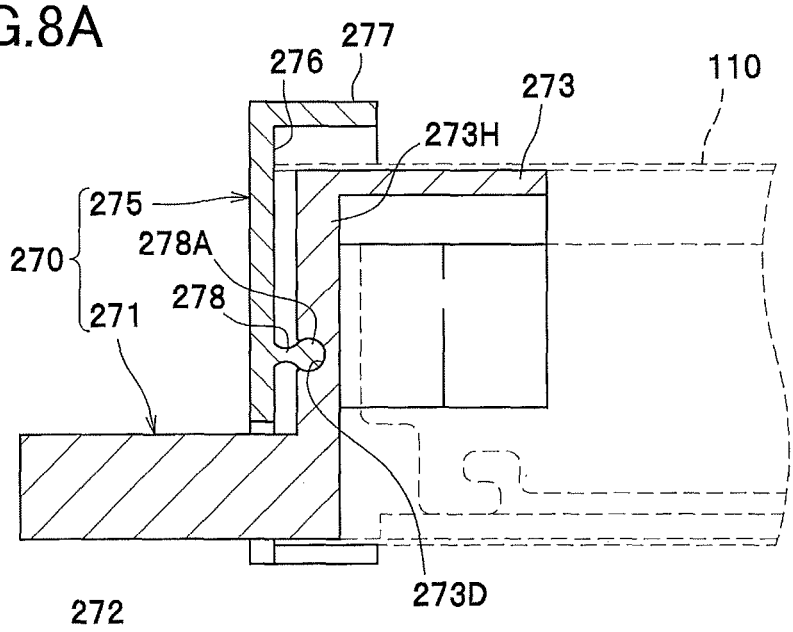
FIG. 8A is a vertical cross-sectional view of a guide member according to a first modification of the embodiment.
Figure 8B:
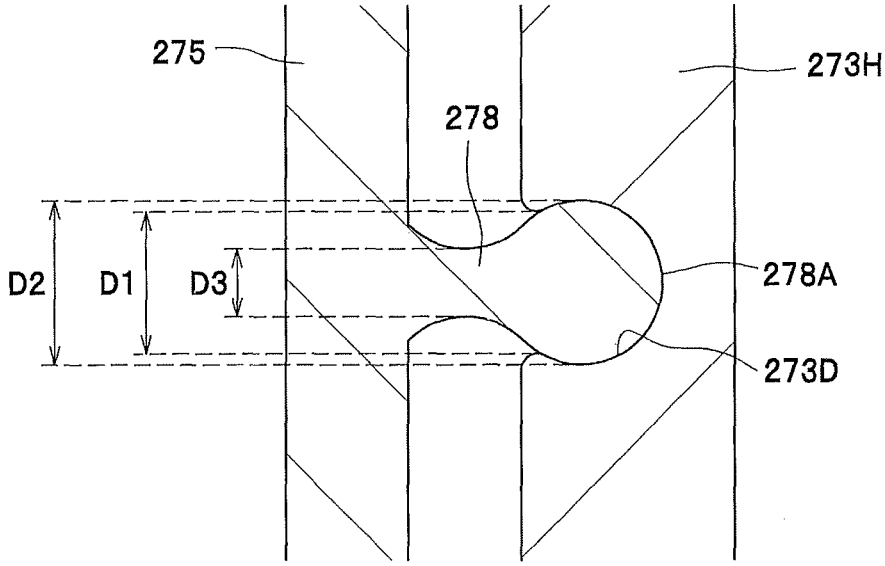
FIG. 8B is a partial enlarged view ambient to a fulcrum point according to the first modification.

Description is given to a configuration different from that of the embodiment. As shown in FIGS. 8A and 8B, a guide assembly 270 includes an inner guide member 271 and a restricting member 275. The restricting member 275 includes a restricting portion 276 facing a connecting portion 273H of the inner guide member 271 and provided with a protruding portion 278 protruding toward the connecting portion 273H. The connecting portion 273H is formed with a spherical receiving portion 273D. The inner guide member 271 includes an inner guide 273, and the restricting member 275 includes an outer guide 277.

As shown in FIG. 8B, the spherical receiving portion 273D is formed with an opening having a diameter D1 smaller than a diameter D2 of a spherical portion 278A receiving a distal end portion of the protruding portion 278. When the spherical portion 278A is pressingly fitted into the spherical receiving portion 273D, the spherical portion 278A is caught by the spherical receiving portion 273D by a resilient deformation of the connecting portion 273H, and accordingly, the restricting member 275 is held on the inner guide member 271. The protruding portion 278 includes a base portion having a diameter D3 smaller than the diameter D1. With this configuration, the restricting member 275 is tiltable about a fulcrum point but immovable in the right-to-left direction. Further, since the spherical receiving portion 273D is provided in the connecting portion 273H rather than a main body 272 of the inner guide member 271, the main body 272 can be downsized. Incidentally, according to the above-described embodiment, pressing force from the fusing film 110 is exerted on a bottom surface of the spherical receiving portion 172D. Therefore, separation of the spherical portion 178A from the spherical receiving portion 172D can be effectively avoided when compared with the first modification.

Figure 9A:
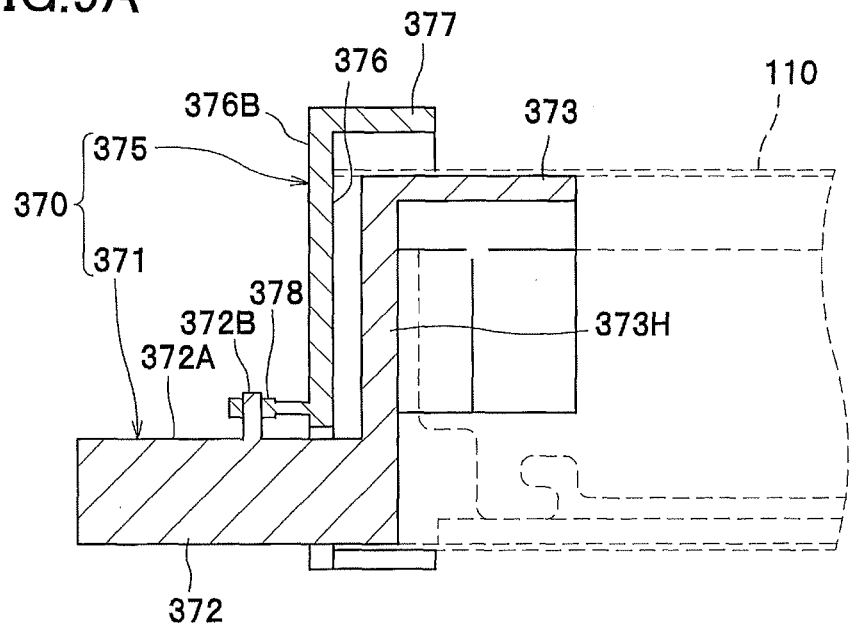
FIG. 9A is a vertical cross-sectional view of a guide member according to a second modification of the embodiment.
Figure 9B:
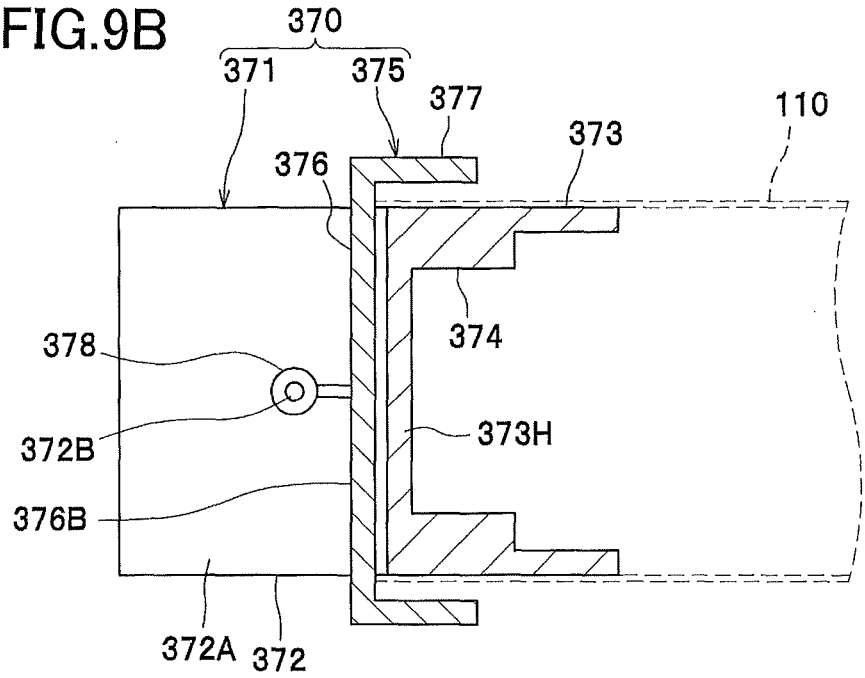
FIG. 9B is a horizontal cross-sectional view of the guide member according to the second modification.

Next, a second modification will be described with reference to FIGS. 9A and 9B in which like parts and components are designated by the same reference numerals but added with 200 as those shown in the above-described embodiment. A guide assembly 370 according to the second modification includes an inner guide member 371 and a restricting member 375. The restricting member 375 is not supported as a pivot support but supported as a pin support using a shaft and a bearing. The inner guide member 371 includes an inner guide 373, and the restricting member 375 includes an outer guide 377.

A main body 372 of the inner guide member 371 has an upper surface 372A provided with a cylindrical pin 372B. The restricting member 375 includes a restricting portion 376 having a side surface 376B provided with an annular portion 378 engaged with the pin 372B and rotatable relative to the pin 372B. With this configuration, the restricting member 375 can be tiltable in a horizontal direction. Since the restricting member 375 can tilt about a vertical axis of the pin 371B in accordance with the slant of the axial end face of the fusing film 110. Accordingly, the deformation and the damage to the fusing film 110 can be restrained in comparison with a configuration in which the restricting member is fixedly provided.

In the above-described embodiment and the first modification, the restricting member 175 and 275 is tiltable in all direction in a gimbal fashion in a virtual plane perpendicular to the right-to-left direction by the employment of the spherical portion 178A, 278A and the spherical receiving portion 172D, 273D. Instead of the above-described structure, a universal joint is available.

While the invention has been described in detail and with reference to the specific and modified embodiments thereof, it would be apparent to those skilled in the art that various changes and modification is available without departing from the scope of the invention.

What is claimed is:

1. A fixing device comprising:

a tubular flexible fusing member rotatable about a rotational axis defining an axial direction and having an inner peripheral surface defining an internal space;

a heater disposed in the internal space;

a nip member disposed in the internal space for receiving radiant heat from the heater, the nip member configured to be in sliding contact with the inner peripheral surface;

a backup member configured to nip the fusing member in cooperation with the nip member;

a restricting member configured to restrict displacement of the fusing member in the axial direction and that is tiltable about a fulcrum portion; and an inner guide member configured to be in sliding contact with the inner peripheral surface to guide the rotation of the fusing member, the restricting member being tiltably supported to the inner guide member, wherein the fulcrum portion is positioned in alignment with the internal space, and wherein one of the inner guide member and the restricting member includes a protruding portion protruding in the axial direction toward the remaining one of the inner guide member and the restricting member, and the remaining one of the inner guide member and the restricting member includes a receiving portion for tiltably supporting the protruding portion, the protruding portion functioning as the fulcrum portion.

2. The fixing device according to claim 1, wherein the fulcrum portion is immovable in the axial direction.

3. The fixing device according to claim 1, wherein the restricting member is tiltably movable in all directions in a gimbal fashion with respect to a virtual plane perpendicular to the axial direction.

4. The fixing device according to claim 1, wherein the fulcrum portion is disposed on an extension of an axial center of the fusing member.

5. The fixing device according to claim 1, wherein the protruding portion has a distal end provided with a spherical portion, and the receiving portion includes a spherical receiving portion fitting with the spherical portion.

6. A fixing device comprising:

a tubular flexible fusing member rotatable about a rotational axis defining an axial direction and having an inner peripheral surface defining an internal space;

a nip member disposed in the internal space, the nip member configured to be in sliding contact with the inner peripheral surface;

a backup member configured to nip the fusing member in cooperation with the nip member;

a restricting member configured to restrict displacement of the fusing member in the axial direction and that is tiltable about a fulcrum portion; and an inner guide member configured to be in sliding contact with the inner peripheral surface to guide the rotation of the fusing member, the restricting member being tiltably supported to the inner guide member, wherein the fulcrum portion is positioned in alignment with the internal space, and wherein one of the inner guide member and the restricting member includes a protruding portion protruding in the axial direction toward the remaining one of the inner guide member and the restricting member, and the remaining one of the inner guide member and the restricting member includes a receiving portion for tiltably supporting the protruding portion, the protruding portion functioning as the fulcrum portion.

7. The fixing device according to claim 6, wherein the fulcrum portion is immovable in the axial direction.

8. The fixing device according to claim 6, further comprising an inner guide member configured to be in sliding contact with the inner peripheral surface to guide the rotation of the fusing member, the restricting member being tiltably supported to the inner guide member.

9. The fixing device according to claim 6, wherein the fulcrum portion is disposed on an extension of an axial center of the fusing member.

10. A fixing device comprising:

a tubular film rotatable about a rotational axis defining an axial direction and having an inner peripheral surface defining an internal space;

a nip plate disposed in the internal space, the nip plate configured to be in sliding contact with the inner peripheral surface;

a backup roller configured to nip the film in cooperation with the nip plate;

a restricting member configured to restrict displacement of the film in the axial direction and that is tiltable about a fulcrum portion; and an inner guide member configured to be in sliding contact with the inner peripheral surface to guide the rotation of the fusing member, the restricting member being tiltably supported to the inner guide member, wherein the fulcrum portion is positioned in alignment with the internal space, and wherein one of the inner guide member and the restricting member includes a protruding portion protruding in the axial direction toward the remaining one of the inner guide member and the restricting member, and the remaining one of the inner guide member and the restricting member includes a receiving portion for tiltably supporting the protruding portion, the protruding portion functioning as the fulcrum portion.

11. The fixing device according to claim 10, wherein the fulcrum portion is immovable in the axial direction.

12. The fixing device according to claim 10, further comprising an inner guide member configured to be in sliding contact with the inner peripheral surface to guide the rotation of the film, the restricting member being tiltably supported to the inner guide member.

13. The fixing device according to claim 10, wherein the fulcrum portion is disposed on an extension of an axial center of the film.

* * * * *